United States Patent [19]

Revelt et al.

[11] Patent Number: 4,629,328

[45] Date of Patent: Dec. 16, 1986

[54] GRAVITY BLENDING APPARATUS AND METHODS OF GRAVITY BLENDING

[75] Inventors: William F. Revelt, Bay City; John B. Prows, Orange, both of Tex.; Fred M. Thomson, Wilmington, Del.; Hugh E. Avery, Hitchcock, Tex.

[73] Assignee: Allied Industries, Inc., Houston, Tex.

[21] Appl. No.: 770,735

[22] Filed: Aug. 29, 1985

[51] Int. Cl.[4] ..... B01F 5/00

[52] U.S. Cl. ..... 366/177; 366/134; 366/182; 366/341

[58] Field of Search ..... 366/113, 101, 118, 131, 366/134, 136, 137, 140, 150, 177, 182, 181, 191–193, 341, 348, 349; 222/199, 200, 459

[56] References Cited

U.S. PATENT DOCUMENTS

| | | | |
|---|---|---|---|
| 3,158,362 | 11/1964 | Seifarth | 366/177 |
| 3,268,215 | 8/1966 | Burton | 366/177 X |
| 3,936,037 | 2/1976 | Leonard, Jr. | 366/177 |
| 4,285,602 | 8/1981 | Hagerty et al. | 366/177 |
| 4,472,064 | 9/1984 | Goins | 366/177 X |
| 4,473,300 | 9/1984 | Goins | 366/341 X |
| 4,553,849 | 11/1985 | Goins | 366/341 X |

*Primary Examiner*—Timothy F. Simone
*Attorney, Agent, or Firm*—Lahive & Cockfield

[57] ABSTRACT

A gravity blending apparatus and methods of gravity blending involving an improved venting arrangement, by means of which an increase in the "thru-put" flow rate of a gravity blender apparatus is provided by venting the underside of an inverted cone within a collecting chamber to one or more low pressure zones. Advantageously, such venting may proceed progressively from the underside of an inverted cone within the collecting chamber to a low pressure zone within the upper portion of the collecting chamber, with venting continuing by way of auxiliary or further venting conduit means to the underside of a material distributing, inverted cone in the lower portion of the base of the main bin of the gravity blender. A gap between the terminus of a central, lower most outlet of the main bin and the apex of the inverted cone within the collecting chamber may be selectively adjusted so as to regulate the relative flow rates of the central, lowermost outlet of the main bin and the peripheral down-comers contained within the main bin which are located circumferentially outwardly of the central outlet and draw material from above the main outlet within the main bin. Such adjusting is able to be effected externally of the main bin and collecting chamber so as to avoid the necessity to obtain access to the interior of these components.

10 Claims, 4 Drawing Figures

GRAVITY BLENDING APPARATUS AND METHODS OF GRAVITY BLENDING

GENERAL BACKGROUND OF INVENTION

Figure 1:
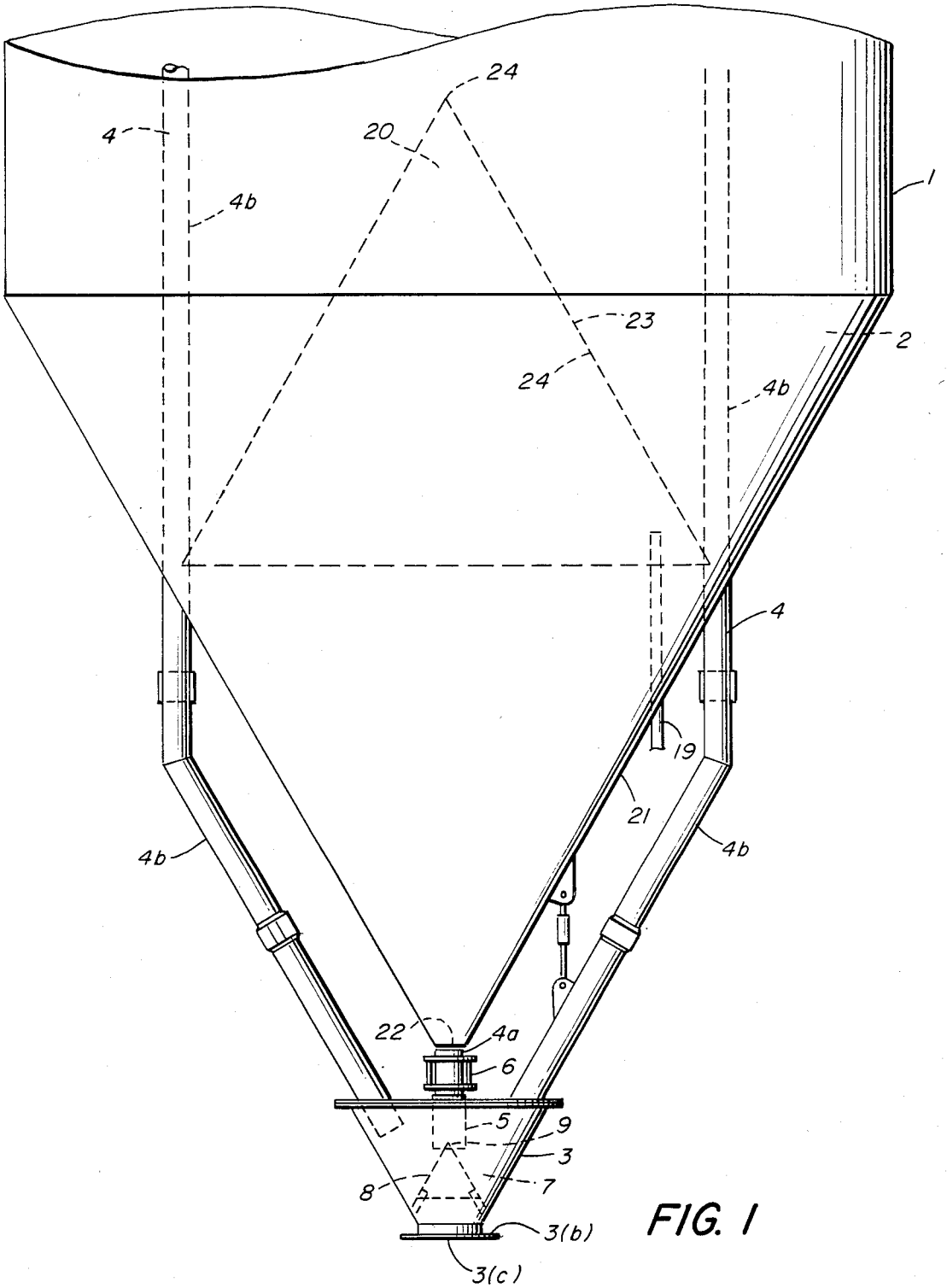

This invention relates to the gravity blending of particulate material such as small plastic pellets, etc.

The purpose of such gravity blending is to extract samples of particulate material from different locations within a bin and re-mix the thus extracted portions of particulate material to provide a more uniform blend of particulate material for subsequent manufacturing operations. Such blending tends to improve the uniformity of the ultimate plastic product or products resulting from manufacturing operation.

The invention relates in particular to gravity blending of the type set forth in U.S. Pat. No. 3,268,215 to Burton (Aug. 23, 1966) assigned to Allied Industries, Inc. of Houston, Tex.

The Burton-type of gravity blending operations involves the discharge of particulate material from a main bin (usually cylindrical with a conical base) by way of a series of generally upright or vertically extending conduits, commonly termed "down comers". Such down comers are provided with a plurality of openings along their longitudinal length, with various varied spacing patterns of such openings usually being provided with various of these down comers.

In the practice of the Burton invention, the dynamics of the particulate material discharge operation, influenced by the presence of particulate material in the bin and the generally fluidized nature of such particulate material as caused by pneumatic conveying of particulate material to the upper portion of the bin during bin filling, tends to cause particulate material to be discharged from any particular down comer at any time generally or mainly from only the upper most open down comer opening located first above the top of the mass of particulate material within the bin. This phenomena is commonly referred to as the "top hole" gravity blending method.

The particulate material thus discharged from the bin, is conveyed by the down-comers to a collecting chamber located beneath the bin where the variously extracted samples or segments of particulate material from different bin locations are integrated or comingled in a collecting chamber. The comingled particulate material within the collecting chamber is then conveyed downwardly through conventional means such as rotary air locks, possibly augmented by a subsequent slide or control valve to a pneumatic conveying line. Blended particulate material reaching the pneumatic conveying line may be transmitted directly to storage or user facilities or may be recirculated through the gravity blender apparatus to provide still further and/or enhanced blending.

In the practice of such gravity blending operations, control over or reduction of fines in particulate material being handled by the gravity blender apparatus may be obtained by employing collecting chamber venting arrangements. One such advantageous blending chamber venting arrangement is featured in U.S. Pat. No. 3,936,037 to Leonard, Jr. (Feb. 3, 1976) also assigned to Allied Industries, Inc.

The present invention is directed to apparatus and methods intended to improve the operations of prior art such as that noted above and will now be considered.

OBJECTS AND BRIEF SUMMARY OF INVENTION

A major object of the present invention is to improve overall blending characteristics of gravity blender apparatus through the unique utilization of inverted cone and venting arrangements incorporated in the collecting chambers of various types of gravity blender apparatus.

A further major object of the invention is to accomplish improved blending uniformity by selectively and adjustably spacing the lower terminus of the central outlet of the bin of the gravity blender apparatus relative to the apex of an inverted cone incorporated in the collecting chamber. It is presently believed that a greater degree of vertical separation between this terminus and inverted cone apex may provide a desirably increased or enhanced out-flow of particulate material from the central discharge conduit of the bin, thereby improving blend uniformity.

A further object of the invention is to optimize and increase the out-flow rate of particulate material which has been intermingled or collected in the collecting chamber through the use of venting arrangements uniquely incorporated with and communicating with the underside of the inverted cone in the collecting chamber.

Yet another object of the invention is to provide a secondary venting arrangement which communicates with outlets from the collecting chamber inverted cone venting system or conduits and which provides a venting flow path leading from a reduced pressure zone in the upper portion of the collecting chamber, generally above particulate material therein, to the underside of an inverted, material distributing cone located in the lower portion of the main bin of the gravity blender.

A still further object of the present invention is to provide an arrangement permitting selective adjustment of the elevation of the terminus of the central conduit of the main bin discharging into the collecting chamber so as to selectively adjust and maximize the distance between this terminus and the apex of the inverted cone in the collecting chamber. This may be done so as to increase the rate of discharge of particulate material from this central outlet, relative to other down comer conduits circumferentially surrounding and spaced outwardly from this central discharge conduit.

Another object of the invention is to provide an adjusting mechanism for the elevation of the terminus of the central discharge conduit of the bin, which adjusting mechanism is selectively and conveniently operable externally of both the bin body and the collecting chamber so as to provide for telescoping adjustment of the terminus and permit the attainment of the desired vertical gap between the central conduit terminus and the apex of the inverted cone in the collecting chamber.

The present invention entails various independently significant apparatus and method formats as delineated in the claims appended to this patent application.

First, independently significant apparatus aspects of the invention will be considered.

A first, independently significant aspect of the invention resides in the following apparatus combination:

bin means operable to store a mass of particulate material;

collecting chamber means disposed generally beneath the bin means;

a plurality of conduits extending between and communicating with each of the bin means and collecting chamber means and operable to convey particulate material from the mass to the collecting chamber means, the plurality of aforesaid conduits including a central conduit located generally centrally of the collecting chamber means, a vertically adjustable lower terminus extending from the central conduit into the collecting chamber means, and adjusting means operable to adjust the elevation of the lower terminus within the interior of said collecting chamber means, inverted cone blending means located within the collecting chamber means and having an upwardly facing apex positioned beneath the lower terminus of the central conduit, with the distance between the lower terminus and the apex being operable to be varied by operation of the adjusting means; and first venting means providing gas communication directly between the underside of the inverted cone blending means and a first zone of reduced pressure generally above particulate material within the collecting chamber means, with the first venting means including a plurality of vent conduits intersecting a lower wall portion of the inverted cone blending means and providing a plurality of gas transmission paths extending from the underside of the inverted cone blending means and operable to communicate with the exterior of the collecting chamber means.

In the context of the foregoing primary apparatus combination, the invention is further independently characterized by apparatus additions including:

a plurality of vent conduits of the first venting means which are generally symmetrically arranged within the collecting chamber means about a generally central upright longitudinal axis of the collecting chamber means relative to portions of the plurality of conduits operable to convey particulate material to the collecting chamber means; and second venting means are included providing gas communication between the top interior of the collecting chamber means and a second zone of reduced pressure.

In the context of either or both of the foregoing apparatus concepts, the invention is further independently characterized and enhanced by the addition of the following combination:

the bin means, in its lower central portion above a particulate material inlet of the central conduit of the plurality of conduits includes a further inverted cone means having an upwardly facing apex, with other conduits of the plurality of conduits discharging particulate material past the further inverted cone means and the inlet of the central conduit to the collecting chamber means; and the further venting means communicates with the second zone of reduced pressure beneath the underside of the further inverted cone means.

In addition, in the context of any or all of the foregoing three independently significant apparatus concepts, this invention may be further characterized wherein:

the lower terminus of the central conduit is telescopingly adjustable longitudinally of the inverted cone blending means, with the adjusting means being operable externally of the bin means and the collecting chamber means to effect such telescoping adjustment of the elevation of lower terminus.

In addition, it is to be realized that the present invention is characterized by independently significant method aspects correspondingly respectively to each of the apparatus aspects noted above.

The apparatus and method aspects of the invention having been summarized, it is now appropriate to give further consideration, without by way of limitation of the invention, to a presently preferred embodiment as illustrated in the appended drawings and discussed in the subsequent detailed description.

BRIEF DESCRIPTION OF DRAWINGS OF PREFERRED EMBODIMENT

In describing the present invention for information purposes, but not by way of limiting the scope of the invention, reference will be made to a presently preferred embodiment as illustrated in the appended drawings.

Figure 2:
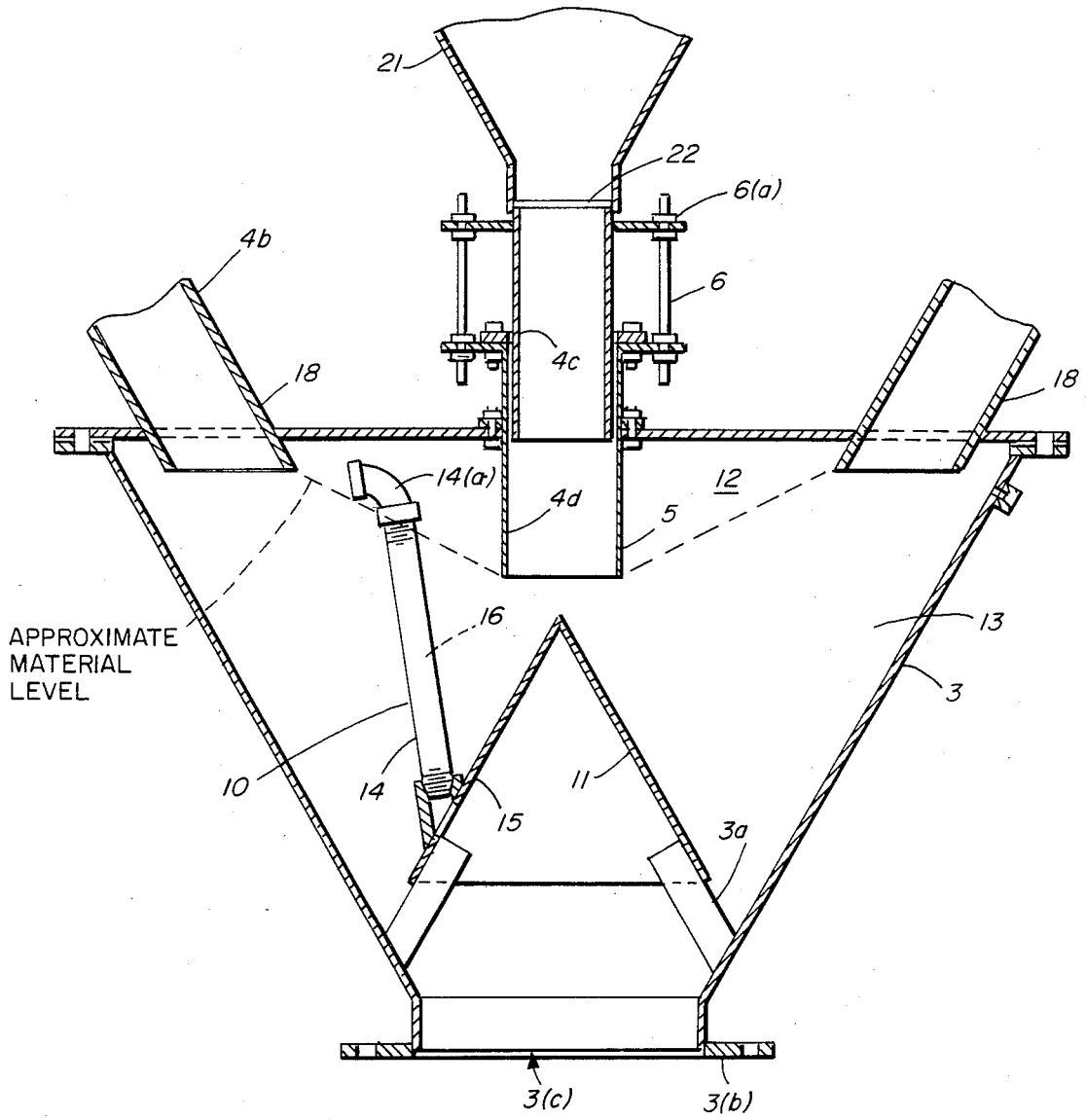
Figure 3:
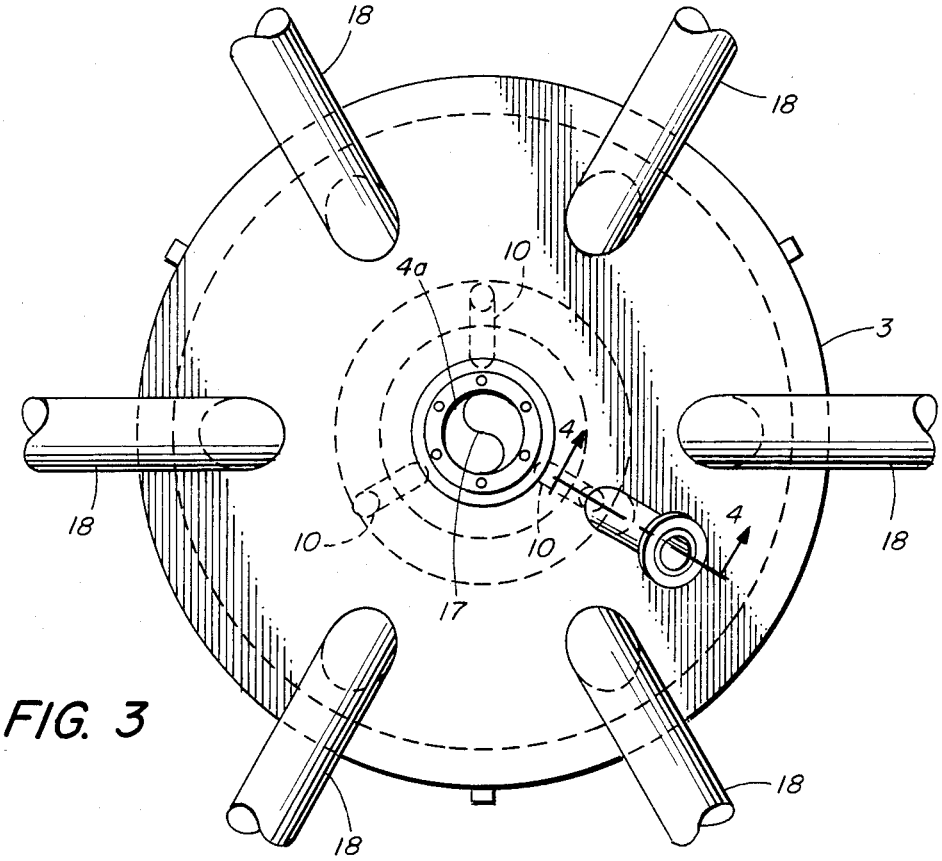
Figure 4:
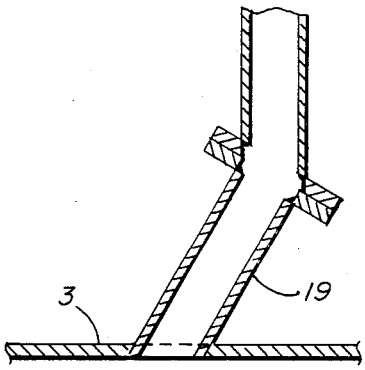

In the drawings:

FIG. 1 provides a fragmentary, elevational view of a lower portion of a gravity blender of the present invention;

FIG. 2 provides an elevational, sectional view of the collecting chamber of the FIG. 1 gravity blender;

FIG. 3 provides a top plan view of the collecting chamber of the FIGS. 1 and 2 gravity blender apparatus; and FIG. 4 provides a sectional view of a top of the collecting chamber of the FIGS. 1, 2, and 3 collecting blender, as viewed generally along section line 4—4 of FIG. 3.

Having described the general content of the appended drawings relating to a presently preferred embodiment of the invention, reference will now be made to a more detailed description of this presently preferred embodiment.

DESCRIPTION OF PRESENTLY PREFERRED EMBODIMENT OF INVENTION

In providing a more detailed discussion of the presently preferred embodiment of the invention, reference will be made first to components including the main bin, the down comers which serve to extract particulate material from various vertical elevations and locations within the bin, and a collecting chamber into which the down comers discharge particulate material to achieve blending.

Secondly, reference will be made to various aspects of venting arrangements which provide venting from the underside of an inverted cone within the collecting chamber means and an extension of this collecting chamber venting arrangement which affords communication to a second zone of reduced pressure beneath a further inverted cone located in the lower portion of the main bin.

A third aspect of the apparatus which will be discussed involves an adjusting arrangement which permits the outflow of the central discharge conduit at the lower end of the main bin, feeding into the collecting chamber, to be selectively adjusted by regulating or selectively varying the gap between the central discharge terminus and the apex of the inverted cone within the collecting chamber.

Bin, Collecting Chamber, and Down-Comers

As shown in the drawings, bin means (1) is operable to store a mass (2) of particulate material. The collecting chamber means (3) is disposed generally beneath the bin means (1). A plurality of conduits (4) comprising down-comers, extend between and communicate with each of the bin means (1) and collecting chamber means (3) and are operable to convey particulate material from the mass (2) to the collecting chamber means (3).

The plurality of conduits (4) includes a central conduit (4*a*) located generally centrally of the collecting chamber means (3), a vertically adjustable lower terminus (5) extending from the central conduit (4*a*) into the collecting chamber means (3), and adjusting means (6) operable to adjust the elevation of the lower terminus (5) within the interior (7) of said collecting chamber means (3). Such adjusting means (6) as shown in FIG. (2) includes telescopable conduit section (4*c*) and (4*d*) which may be selectively telescoped or extended by conventional screw-jack.

An inverted cone blending means (8) is located within the collecting chamber means (3) and has an upwardly facing apex (9) positioned beneath the lower terminus (5) of the central conduit (4*a*). Inverted cone means (8) is supported within and spaced from the inner periphery of chamber 3 by spaced gussetts (3*a*). The distance between the lower terminus (5) and the apex (9) is operable to be varied by operation of the screw jack adjusting means (6*a*).

Venting Arrangements

The apparatus includes first venting means (10) providing gas communication directly between the underside (11) of the inverted cone blending means (8) and a first zone (12) of reduced pressure located generally above particulate material (13) within the collecting chamber means (3).

The first venting means (10) includes a plurality of vent conduits (14) intersecting a lower wall portion (15) of the inverted cone blending means (8) and provides a plurality of gas transmission paths (16) extending from the underside (11) of the inverted cone blending means (8) and operable to communicate with the exterior of the collecting chamber means (3).

The plurality of vent conduits (14) of the first venting means (10) are generally symmetrically arranged within the collecting chamber means (3) about a generally central, upright longitudinal axis (17) of the collecting chamber means (3) relative to portions (18) of the plurality of conduits (4) which extend out of the base of bin means (1) and are operable to convey particulate material to the collecting chamber means (3).

A second venting means (19) may also be included which provides gas communication between the top interior (12) of the collecting chamber means (3) and a second zone (20) of reduced pressure within the interior of the invented cone (23) supported within the bass of bin (1).

The bin means (1), in its lower central portion (21), above a particulate material inlet (22) of the central conduit (4*a*) of the plurality of conduits (4) includes a further inverted cone means (23). This cone means (23) has an upwardly facing apex (24), with other conduits (4*b*) of the plurality of conduits (4) discharging particulate material past the further inverted cone means (23) and the inlet (22) of the central conduit (4*a*) to the collecting chamber means (3).

The further venting means (19) communicates with the second zone of reduced pressure (20) beneath the underside (24) of the further inverted cone means (23).

Flow Adjusting Mechanism for Central, Lower Outlet of Main Bin

As shown in FIG. 2, the lower terminus (5) of the central conduit (4*a*), i.e. portion (4*d*), with respect to portion (4*c*), is telescopingly adjustable longudinally of the inverted cone blending means (8).

The adjusting screw jack means (6*a*) is operable externally of the bin means (1) and the collecting chamber means (3) to effect such telescoping adjustment so as to selectively adjust the elevation of lower terminus (5), and thus the flow capacity of central conduit 4(*a*) into collecting chamber means (3).

SUMMARY OF METHODS OF OPERATION

While the aforegoing description of apparatus inherently provides an understanding of the methods of operation of the present invention, a brief overview of such methods may be of use at this point.

As will be understood, and as is conventional in the art, pneumatic gas conveying means introduce particulate material to be blended into the upper portion of the bin (1). During this introduction of particulate material to be blended, the lower outlet (3*c*) of the connecting chamber, at the lower end (3*b*) of the collecting chamber, may, through appropriate piping connections, be placed in consecutive communication with a rotary air lock valve and then, possibly, with a slide-type close off valve. These valves provide controlled communication between the discharge outlet (3*c*) of the collecting chamber (3) and conventional pneumatic conveying lines which serve to pneumatically convey blended particulate material to a storage site, work site, or to a recirculation system so as to obtain recirculation of the first blended particulate material through the gravity blending apparatus for additional or enhanced blending.

Since such pneumatic conveying and valve arrangements are now conventional and well known and understood in the art, further consideration of these components need not be undertaken.

Material within the interior of the bin (1) is discharged through peripheral down-comers (4*b*) into the collecting chamber (3) by way of the "top-hole" principle, earlier discussed, so as to extract samples of particulate material from different elevations and locations within the blender for overall blending purposes. Such material flows through the peripheral down-comers (4*b*), past the inverted cone (23), and into the collecting chamber (3). The inverted cone (23), at its lower or widest portion is spaced radially from the inner wall of the upright generally conical lower portion of the bin (1) so as to provide an annular gap through which particulate material flows to the central bin discharge conduit (4*a*).

Regulation of the relative rates of flow of particulate material to the central conduit (4*a*) and the peripheral conduits or down-comers (4*b*) is obtained by adjusting the elevation of the central conduit terminus (5) through operation of the adjusting mechanism (6). Since the adjusting mechanism (6) comprise a plurality of screw jack means (6*a*) which are located externally of bin (1) and collecting chamber (3), such adjusting manipulations may be conveniently effected without requiring access to the interior of the bin (1) or the collecting chamber means (3). The simplicity of the telescoping arrangements of the components (4c) and (4d) of the central discharge conduit (4a) provides structural simplicity and reliability in connection with this adjusting mechanism.

Within the collecting chamber means (3), material discharged thereinto by way of the portions (18) of the peripheral conduits (4b) and the central conduit terminus (5) accummulate to an upper material level which provides an air space or gap (12) at the upper end of the collecting chamber (3).

Such accummulated material flows out of the outlet (3c) by passing around the inverted cone (8) by way of the annular gap between the lower or widest portion of the inverted cone (8) and the inner wall of the collecting chamber means (3), as permitted by the circumferential gaps between the cone supporting, gussetts (3a).

During such outflow operations, a pressure buildup which might impede flow around the inverted cone and through the outlet (3c) is prevented by utilization of the primary venting system (10), including the venting conduit components (14). The conduits (14) of the venting system (10) which should be symmetrically arranged about axis (17), may be provided with elbow type fittings (14a) at the upper ends so as to permit the discharge of venting air from the underside of the inverted cone to be directed so as not to be oriented toward the secondary venting conduit (19) at the upper end of the collecting chamber (3) or toward or into the outlets of the down-comer extremities (18).

The secondary venting conduit (19) provides further venting communication between the low pressure zone (12) into a further low pressure zone (20) underlying the main or large inverted cone (23) supported by bracing in the base of main bin (1). As shown in FIG. 1, secondary venting conduit (23) extends through an elbow upwardly through the conical lower wall of the bin (1) into the open, under side of the inverted cone (23).

It is contemplated that the upper end of venting conduit (19) may preferably terminate above the level of particulate material in the vicinity of the underside of the cone (23).

As has been earlier noted, material passing downwardly through downcomers (4b) is deflected by inverted cone (23) in the base of bin (1) so as to be deflected toward the lower most openings in peripheral down-comers (4b) positioned generally adjacent the lower or widest extremity of the inverted cone (23).

Summary of Major Advantages and Scope of Invention

A primary advantage of the invention resides in the manner in which the primary inverted cone venting arrangement (10) of the collecting chamber means (3) prevents a pressure build-up underneath the inverted cone (8). This prevention of pressure build-up insures and provides an enhanced or markedly increased flow rate out of the collecting chamber outlet (3c), thereby improving or increasing the thru-put flow capacity of the blender apparatus. In testing, improvements in thru-rate flow capacity have been obtained on the order of about 40%.

Enhanced blending is presently believed to be achieved by increasing the vertical gap between the terminus (5) and the inverted cone apex (9) of the collecting chamber so as to generally tend to increase the ratio of discharge of particulate material from the base of the bin (1) through the central, lower most outlet (4a), in comparison with flow rates through the peripheral down comers (4b).

The continuation of the primary venting system (10) by way of secondary venting extension means (19) from the low pressure zone (12) in the collecting chamber means (3) to the further low pressure zone beneath the main inverted cone (23) in the bin (1) serves to provide effective overall venting. This prevents flow-impeding, pressure build ups within the system which could otherwise impede the enhanced flow through lower central bin conduit (4a) and further may tend to control, regulate, or reduce the amount fines in the blended product issuing from the collecting chamber means if filters are associated with line 19.

The ability to "fine-tune" or regualte the ratio of discharge flow from the central bin conduit (4a) and the peripheral down comers (4b) enables blending to be optimized for various types of particulate material products. The ability to significantly raise terminus (5) in comparison with past practices is presently believed to provide an increased degree of discharge of flow material from the central lower portion of the bin (4a), thereby improving the uniformity of the final blended product.

The ability to effect the adjustment of the gap between terminus (5) and the cone apex (9) is conveniently and easily accommodated by telescoping manipulations of telescoped and relatively moveable tubular components (4c) and (4d). As shown in FIG. 2, telescoped components (4c) and (4d) are selectively telescopable or extendable by operation of a conventinal screw jack mechanisms (6a) comprising a plurality of screw jack rods into connecting conduit components (4d) and (4c). An operator can conveniently operate these screw jack mechanisms so as to adjust the relatively telescoped position of components (4c) and (4d) externally of bin (1) and collecting chamber (3), thereby obtaining gap adjustment without requiring access to the interior of bin (1) or collecting chamber means (3). This arrangement is believed to advantageously contrast with the prior art disclosure of bin central tube, external valving as featured in U.S. Pat. No. 3,456,922 to Goins (July 22, 1969).

It will be especially recognized that the further venting conduit means (19) which provides communication between the first zone of reduced pressure (12) and the second zone of further reduced pressure (20) serves to effectively prevent a pressure build up or accummulation in the underside of the inverted cone (8) which might otherwise adversely affect the ability of the down-comer extremeties to provide adequate flow rates into the collection chamber means (8). This insures that the flow enhanced operation of the lower most bin conduit (4a) is not adversely impeded.

It is also to be recognized that while the detailed description of the invention has focused on claimed and novel features, conventional gravity blender mechanisms such as filters, valve controls, etc., well recognized in the art will undoubtedly be employed in some or most installations.

For example, the inclusion of filters or dust removers in the further venting means conduit (23) may well provide to effectively remove fines from the system so as to avoid the development of excessive or unwanted fines levels in the out flow of the gravity blender.

In describing the presently preferred embodiment of the invention, those skilled in the gravity blender art and familiar with the disclosure of this present invention may well recognize additions, deletions, substitutions, modifications, and equivalent arrangements which would fall within the scope of the invention which is deemed to be set forth in the appended claims.

What is claimed is:

1. A gravity blender apparatus comprising:

bin means operable to store a mass of particulate material;

collecting chamber means disposed generally beneath said bin means;

a plurality of conduits extending between and communicating with each of said bin means and collecting chamber means and operable to convey particulate material from said mass to said collecting chamber means, with said plurality of conduits including a central conduit located generally centrally of said collecting chamber means, a vertically adjustable lower terminus extending from said central conduit into said collecting chamber means, and adjusting means operable to adjust the elevation of said lower terminus within the interior of said collecting chamber means, inverted cone blending means located within said collecting chamber means and having an upwardly facing apex positioned beneath said lower terminus of said central conduit, with the distance between said lower terminus and said apex being operable to be varied by said operation of said adjusting means; and venting means providing gas communication directly between the underside of said inverted cone blending means and a zone of reduced pressure generally above particulate material within said collecting chamber means, with said venting means including a vent conduit intersecting a lower wall portion of said inverted cone blending means and providing a gas transmission path extending from the underside of said inverted cone blending means and operable to communicate with the exterior of said collecting chamber means.

2. A gravity blender apparatus comprising:

bin means operable to store a mass of particulate material;

collecting chamber means disposed generally beneath said bin means;

a plurality of conduits extending between and communicating with each of said bin means and collecting chamber means and operable to convey particulate material from said mass to said collecting chamber means, with said plurality of conduits including a central conduit located generally centrally of said collecting chamber means, a vertically adjustable lower terminus extending from said central conduit into said collecting chamber means, and adjusting means operable to adjust the elevation of said lower terminus within the interior of said collecting chamber means, inverted cone blending means located within said collecting chamber means and having an upwardly facing apex positioned beneath said lower terminus of said central conduit, with the distance between said lower terminus and said apex being operable to be varied by said operation of said adjusting means;

first venting means providing gas communication directly between the underside of said inverted cone blending means and a first zone of reduced pressure generally above particulate material within said collecting chamber means, with said first venting means including a plurality of vent conduits intersecting a lower wall portion of said inverted cone blending means and providing a plurality of gas transmission paths extending from the underside of said inverted cone blending means and operable to communicate with the exterior of said collecting chamber means, with said plurality of vent conduits of said first venting means being generally symmetrically arranged within said collecting chamber means about a generally central upright longitudinal axis of said collecting chamber means relative to portions of said plurality of conduits operable to convey particulate material to said collecting chamber means; and second venting means providing gas communication between the top interior of said collecting chamber means and a second zone of reduced pressure.

3. A gravity blender apparatus as described in claim 2 wherein:

said bin means, in its lower central portion above a particulate material inlet of said central conduit of said plurality of conduits, includes a further inverted cone means having an upwardly facing apex, with other of said plurality of conduits discharging particulate material past said further inverted cone means and said inlet of said central conduit to said collecting chamber means; and said further venting means communicates with said second zone of reduced pressure beneath the underside of said further inverted cone means.

4. A gravity blender apparatus as described in claim 2 wherein:

said lower terminus of said central conduit is telescopingly adjustable longitudinally of said inverted cone blending means, with said adjusting means being operable externally of said bin means and said collecting chamber means to effect said telescoping adjustment.

5. A gravity blender apparatus as described in claim 4 wherein:

said lower terminus of said central conduit is telescopingly adjustable longitudinally of said inverted cone blending means, with said adjusting means being operable externally of said bin means and said collecting chamber means to effect said telescoping adjustment.

6. A method of gravity blending particulate material comprising:

providing bin means operable to store a mass of particulate material;

providing collecting chamber means disposed generally beneath said bin means;

providing a plurality of conduits extending between and communicating with each of said bin means and collecting chamber means and operable to convey particulate material from said mass to said collecting chamber means, with said plurality of conduits including a central conduit located generally centrally of said collecting chamber means, a vertically adjustable lower terminus extending from said central conduit into said collecting chamber means, and adjusting means operable to adjust the elevation of said lower terminus within the interior of said collecting chamber means, providing inverted cone blending means located within said collecting chamber means and having an upwardly facing apex positioned beneath said lower terminus of said central conduit, with the distance between said lower terminus and said apex being operable to be varied by said operation of said adjusting means; and providing venting means providing gas communication directly between the underside of said inverted cone blending means and a zone of reduced pressure generally above particulate material within said collecting chamber means, with said venting means including a vent conduit intersecting a lower wall portion of said inverted cone blending means and providing a gas transmission path extending from the underside of said inverted cone blending means and operable to communicate with the exterior of said collecting chamber means.

7. A method of gravity blending particulate material comprising:

providing bin means operable to store a mass of particulate material;

providing collecting chamber means disposed generally beneath said bin means;

providing a plurality of conduits extending between and communicating with each of said bin means and collecting chamber means and operable to convey particulate material from said mass to said collecting chamber means, with said plurality of conduits including a central conduit located generally centrally of said collecting chamber means, a vertically adjustable lower terminus extending from said central conduit into said collecting chamber means, and adjusting means operable to adjust the elevation of said lower terminus within the interior of said collecting chamber means, providing inverted cone blending means located within said collecting chamber means and having an upwardly facing apex positioned beneath said lower terminus of said central conduit, with the distance between said lower terminus and said apex being operable to be varied by said operation of said adjusting means;

providing first venting means providing gas communication directly between the underside of said inverted cone blending means and a first zone of reduced pressure generally above particulate material within said collecting chamber means at the top interior of said collecting chamber means, with said first venting means including a plurality of vent conduits intersecting a lower wall portion of said inverted cone blending means and providing a plurality of gas transmission paths extending from the underside of said inverted cone blending means and operable to communicate with the exterior of said collecting chamber means, with said plurality of vent conduits of said first venting means being generally symmetrically arranged within said collecting chamber means about a generally central upright longitudinal axis of said collecting chamber means relative to portions of said plurality of conduits operable to convey particulate material to said collecting chamber means; and providing second venting means providing gas communication between the top interior of said collecting chamber means and a second zone of reduced pressure exterior of said collecting chamber means.

8. A method of gravity blending particulate material as described in claim 7 wherein:

said bin means, in its lower central portion above a particulate material inlet of said central conduit of said plurality of conduits includes a further inverted cone means having an upwardly facing apex, with other of said plurality of conduits discharging particulate material past said further inverted cone means and said inlet of said central conduit to said collecting chamber means; and said further venting means communicates with said second zone of reduced pressure beneath the underside of said further inverted cone means.

9. A method of gravity blending particulate material as described in claim 7 wherein:

said lower terminus of said central conduit is telescopingly adjustable longitudinally of said inverted cone blending means, with said adjusting means being operable externally of said bin means and said collecting chamber means to effect said telescoping adjustment.

10. A method of gravity blending particulate material as described in claim 9 wherein:

said lower terminus of said central conduit is telescopingly adjustable longitudinally of said inverted cone blending means, with said adjusting means being operable externally of said bin means and said collecting chamber means to effect said telescoping adjustment.

* * * * *